US006071166A

United States Patent [19]

Lebensfeld et al.

[11] Patent Number: 6,071,166

[45] Date of Patent: Jun. 6, 2000

[54] LIGHT SHOOTING AND DETECTING TOY FIGURES

[75] Inventors: Steven Lebensfeld, Laurel Hollow, N.Y.; David Chu Ki Kwan, Hong Kong, The Hong Kong Special Administrative Region of the People's Republic of China; Harvey Goldberg, Thornhill, Canada; Carmine Russo, West Islip, N.Y.

[73] Assignee: Toymax Inc., Plainview, N.Y.

[21] Appl. No.: 09/063,816

[22] Filed: Apr. 21, 1998

[51] Int. Cl.[7] ..... A63H 30/00; A63H 5/04; A63H 33/30

[52] U.S. Cl. ..... 446/175; 446/406; 446/473; 446/485; 463/52

[58] Field of Search ..... 446/175, 268, 446/297, 405, 406, 473, 485; 434/11, 21, 22, 24; 413/5, 50, 51, 52

[56] References Cited

U.S. PATENT DOCUMENTS

| | | | |
|---|---|---|---|
| 3,294,401 | 12/1966 | Nicholas et al. | 463/52 |
| 3,508,751 | 4/1970 | Meyer et al. | 463/50 |
| 3,531,891 | 10/1970 | Goldfarb et al. | 446/485 X |
| 4,626,222 | 12/1986 | Sweet | 446/268 |
| 4,696,654 | 9/1987 | Welch et al. | 446/268 |
| 4,772,028 | 9/1988 | Rockhold et al. . | |
| 4,874,343 | 10/1989 | Rosenthal . | |
| 4,902,262 | 2/1990 | Lunsford | 446/268 |
| 5,904,621 | 5/1999 | Small et al. | 463/52 |

*Primary Examiner*—D. Neal Muir

*Attorney, Agent, or Firm*—Brown Raysman Millstein Felder & Steiner LLP

[57] ABSTRACT

The invention disclosed herein provides toy objects such as action figures, robots, vehicles, creatures, etc., with apparatus for playing a shooting game controlled by one or more human players. Each toy object includes either a energy emitter, a energy sensor, or both. The toy objects are manipulatable by the players to face the emitters and the sensors in directions to hit other objects with radiated energy or avoid being hit with radiated energy from other objects. In the preferred embodiment, the emitter radiates infrared light and the sensor detects infrared light, and are operated from a backpack movably attached to an action figure. Control of radiating and detecting infrared light is similar to the control in a currently popular "laser" shooting games available from Toymax Inc. under the trademark "Laser Challenge".

22 Claims, 4 Drawing Sheets

LIGHT SHOOTING AND DETECTING TOY FIGURES

BACKGROUND OF THE INVENTION

The invention disclosed herein relates to toy objects equipped with a radiating (wave) energy (e.g., light) projector, a radiated energy detector, or both, which may be configured as action figures (including dolls), robots, vehicles, etc., and which are manipulatable by a human player, or by remote control, to play a shooting game in which the toy objects are the participants.

Toys for playing a shooting game in which human players are the participants are currently available, for example, from Toymax Inc. of Plainview, N.Y. under the trademark "Laser Challenge". The following U.S. patent applications, the disclosures of all of which are incorporated herein by reference, relate to toy light projecting and/or detecting guns and targets marketed by Toymax Inc.: 08/795,895, filed Feb. 5, 1997, titled "Interactive Light-Operated Toy Shooting Game"; Ser. No. 08/871,248, filed Jun. 9, 1997, titled "Interactive Toy Shooting Game Having A Feelable Output"; Ser. No. 09/15,863, filed Jan. 29, 1998, titled "Player Programmable, Interactive Toy For A Shooting Game"; and Ser. No. 09/19,747, filed Feb. 6, 1998, titled "Computer Programmable, Interactive Toy For A Shooting Game". These applications are referred to below as "the cited patent applications".

U.S. Pat. Nos. 5,375,847 and 4,844,474 discloses toys which detect light fired from a gun operated by a human player. In the '847 patent, the toy is a toy soldier which topples when hit. In the '474 patent, the toy is a vehicle which mechanically explodes when hit.

The patent applications and patents identified above disclose apparatus used by at least one player as a direct participant in a shooting game, whereas the invention herein relates to toy objects in the form of toy action figures, robots, vehicles, etc., which are the game participants and are provided with shooting and detecting apparatus. Of course, children have long used passive toy objects as participants in shooting games simulated entirely by imagination, i.e., a child manipulates the toy object, provides sound effects and determines in his or her imagination whether the toy object hit the intended target. As disclosed for example in U.S. Pat. No. 5,073,140, the disclosure of which is incorporated herein by reference, sound effects and speech may be provided to such otherwise passive toy objects. However, there is no interactivity between these passive toy pieces.

U.S. Pat. Nos. 4,840,602 and 4,857,030 disclose toy dolls which each generate voice messages to which the other apparently responds. Though there is apparent interactivity between the dolls, a child is more of an observer than a participant in that interactivity.

In today's hi tech environment, where electronic toys are ubiquitous, and electronic and computer games are being played by younger and younger children, non-interactive and purely mechanical toys have little play value for use in a shooting game. More realism with less imagination is needed to attract and hold the attention of modern children. At the same time, electronics and high tech in toys are frequently accompanied by high cost.

U.S. Pat. No. 4,938,483 discloses a multi-vehicle interactive toy system comprising military tanks controlled wirelessly with a joystick that shoot and detect infrared ("IR") light. The toy objects disclosed in the '483 patent are required to perform interactive tasks under remote control, and likely are relatively expensive and may be difficult for younger children to operate. See also U.S. Pat. No. 5,127,658.

U.S. Pat. No. 5,029,872 discloses a spaceship toy also controlled by a joystick (though not wirelessly) that fires light at targets embedded in a screen. The targets disclosed in the '872 patent do not move, and do not shoot back. Also, the space ship does not include a detector for detecting light shot at the space ship. Although the toy disclosed in the '872 patent is interactive, i.e., the targets on the screen detect light shot at them and indicate hits, a game played with a stationary screen is not very realistic or interactive, especially after playing a few games.

OBJECTS AND SUMMARY OF THE INVENTION

There is a need for a simple, low cost toy which provides high tech, interactive toy objects which participate in a shooting game under control of one or more human players.

It is an object of the invention disclosed herein to provide such a toy.

It is another object of the invention to provide toy objects which radiate energy, and can be simply controlled, e.g., moved, aimed and fired by a player, and/or which detect radiated energy and can be simply moved to avoid being hit.

It is another object of the invention to embody the toy objects described herein as various objects with which children have traditionally played, such as human, space, animal or creature action figures, military and space vehicles, etc.

It is another object of the invention to provide toy parts removably or non-removably attached to, or forming a part of, toy objects which incorporate an energy emitter, or sensor, or indicating device, or circuit, or combinations thereof.

It is another object of the invention to provide such toy figures in greatly reduced scales as compared to the height of the actual or imagined object, e.g., ranging down to a few inches in height.

The invention provides interactive toy objects which project (emit) and/or detect radiated energy , and which are manually controlled by one or more players. Though manually controlled, these toy objects are high tech in that they project and/or detect radiated energy. (Radiation, radiated and wave energy are meant in a broad sense to encompass visible and IR light energy, electromagnetic energy, electrostatic energy, sound energy, etc.) Complex and expensive electronics are not needed, but the high tech effect of a radiated energy shooting game, for example, a laser-type shooting game, is nonetheless realized. Thus, the invention can provide the play value of a high tech toy at low cost.

The invention also provides a toy part, e.g., an accessory, for a toy object to which are mounted or coupled some or all of the components used to project and detect radiated energy, and the combination of the accessory and the toy object. Such a toy part can facilitate manufacture of a toy which includes a radiation emitter and sensor (detector), particularly in the case of small toys such as action figures (including dolls) and miniature vehicles. (Radiation sensor and radiation detector are meant in a broad sense and sometimes are used interchangeably herein. A radiation sensor and a radiation detector typically provide an output in response to received radiation. A detector may include processing circuitry. Use of each term may encompass the other, unless the context indicates otherwise.)

When made removable, such a toy part provides play value in addition to the play value resulting from the high tech nature of a radiated energy shooting game. For example, toy parts can be made interchangeable and provided with different features, capabilities, configurations, visual appearances, etc. Children can collect an inventory of toy parts, and choose depending upon the particular shooting game or set of conditions. Play value is provided in collecting such toy parts, choosing the appropriate toy part, and the ability to use different toy parts, which also reduces the possibility that the child will become bored with the same, unchangeable toy.

The invention toy part may be an accessory such as a backpack for an action figure, or a removable emitter, e.g., one that can be plugged into and unplugged from the toy object or the toy part therefor, or a part of a vehicle such as a tank turret. The emitter preferably is associated with a weapon or a feature of the toy object.

The invention provides numerous inventive embodiments and configurations of the toy objects and the accessory.

As discussed above, remote control of toys imparts play value to the toys, as does use of removable parts including accessories and emitters for the toy objects disclosed herein. It is within the contemplation of the invention to provide toy objects with removable parts that are also remote controlled, i.e., the toy object, the toy part may be remote controlled. Such remote control may be achieved conventionally using radio transmission or infrared light transmission.

In one configuration, the invention provides a toy which includes a plurality of toy objects which are compatible (e.g., with respect to operability, theme (e.g., military, police, space, etc.), size, visual appearance, configuration, etc. ) for playing a shooting game in which the objects, as manually controlled by one or more human players, are game participants. The toy comprises a first toy object including a first energy source that radiates (emits) energy and a first circuit coupled to the energy source to cause the energy source to selectively radiate energy. The first toy object is manually movable during play by a human player to direct radiated energy from the first energy source in a selectable direction.

The toy comprises a second toy object including a first energy sensor responsive to energy radiated (emitted) by the energy source of the first toy object and a second circuit coupled to the sensor which makes a determination that a hit has occurred when energy received by the sensor is compatible with energy emitted by the energy source of the first toy object. The second toy object is manually movable during play by a human player to face the first energy sensor in a selectable direction. The toy also comprises at least one hit indicator device coupled to the second circuit which is responsive to the second circuit to provide an audible or visual output when the second circuit determines a hit has occurred.

The first and second circuits may be located with the respective first and second toy objects, or elsewhere, e.g., together and coupled to the respect toy object.

In various embodiments:

the first toy object is provided with a toy weapon to which the energy source is mounted to radiate energy therefrom; the second toy object includes a second energy source that selectively radiates energy, is coupled to a circuit which causes the second energy source to selectively radiate energy, and is manually movable during play by a human player to direct radiated energy from the second energy source in a selectable direction;

the first toy object includes a second radiated energy sensor coupled to a circuit which makes a determination that a hit has occurred when energy received by the second sensor is compatible with energy emitted by the second energy source of the second toy object, and is manually movable during play by a human player to face the second energy sensor in a selectable direction;

the toy comprises at least one other hit indicator device coupled to the circuit to which the second sensor is coupled responsive thereto to provide an audible or visual output when that circuit determines a hit has occurred;

the second toy object has a toy weapon and the second energy source is mounted to radiate wave energy from that weapon;

the emitters may be removably mounted and interchangeable with other toy objects;

one or both toy objects are toy action figures.

In another configuration, the invention provides a toy part such as an accessory for a toy object for playing a shooting game in which the object is a participant in the shooting game. The accessory is configured to be compatible with the toy object and is removably attached to, or non-removably attached to or forming part of, the toy object. The accessory includes a circuit having an input and an output, and is responsive to the input to cause an energy source coupled thereto to selectively radiate energy and is responsive to a radiated energy sensor coupled to the output which is responsive to energy radiated by another wave energy source to make a determination that a hit has occurred when energy received by the sensor is compatible with energy emitted by the other energy source. The circuit is responsive to a determination of a hit causing a hit indicator device coupled to the circuit to provide an audible or visual output.

In various embodiments:

the toy part includes the emitter, the sensor and the hit indicator device;

the emitter, the sensor and/or the hit indicator are electrically coupled to the circuit and are adapted to be attached to and supported by the toy object;

the emitter may be removably attached to, or non-removably attached to, or form part of the toy part or the toy object;

the input comprises a manually actuatable switch;

the accessory is a backpack for an action figure toy object;

the toy part may be a base to which is mounted the toy object.

A backpack accessory may be removably or non-removably attached to the action figure. In a removable embodiment, the backpack includes means for removably attaching it to the action figure. In this embodiment, the emitter is mounted to a member which is non-removably coupled to the backpack. However, the emitter may be removably attached to the backpack, and interchangeable with other emitters which can selectively be attached to different backpack accessories.

The invention also provides combinations of toy parts and incorporating an emitter and toy objects, including combinations of toy parts, backpack accessories, weapons and action figures. The toy parts, accessories, weapons and toy objects may be removably coupled so that various different combinations and effects may be obtained by interchanging toy parts, accessories, weapons and objects.

As mentioned above, embodiments which removably attach an emitter or toy part may add play value over toy objects with non-removable emitters or toy parts which are remote controlled, and such embodiments are within the contemplation of the invention.

In another configuration, the invention provides a toy object configured to represent a mobile object for playing a shooting game in which the object is a participant. The toy object comprises an energy sensor, a circuit and a hit indicator device as described above, but not an energy emitter. In play, this toy figure may represent an unarmed toy object, such as a miliary transport vehicle, or a satellite, etc. A game may be played in which the players manipulate toy objects with emitters to hit the unarmed target before it reaches its intended destination or before it performs an intended task, etc.

BRIEF DESCRIPTION OF THE DRAWINGS

The invention is illustrated in the figures of the accompanying drawings which are meant to be exemplary and not limiting, in which like numerals in the different figures refer to like or corresponding parts, and in which.

DESCRIPTION OF THE PREFERRED EMBODIMENTS

Figure 1:
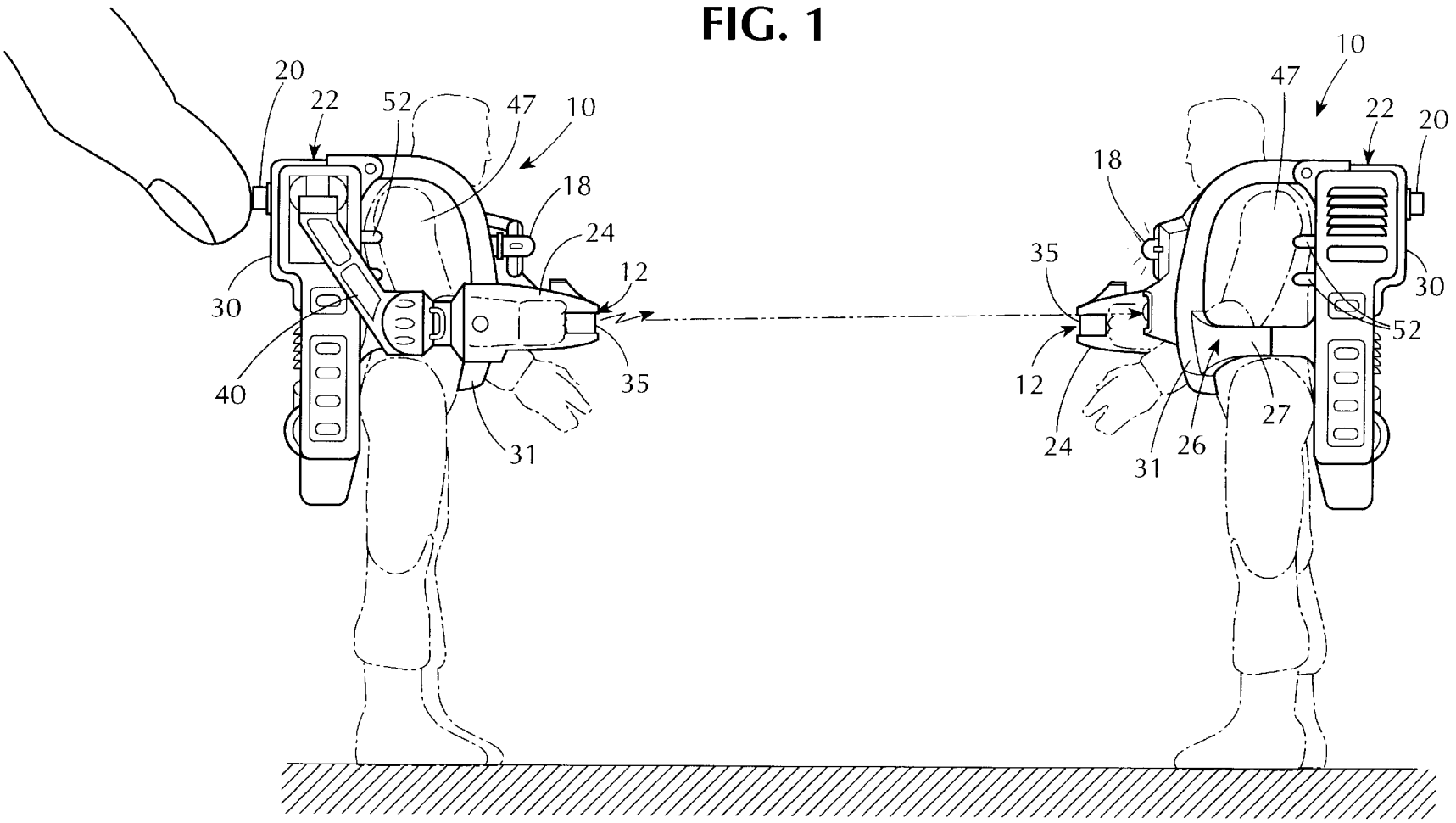
FIG. 1 is a side view of a two toy action figures embodying the invention armed with light emitters engaged in a shooting game.
Figure 2:
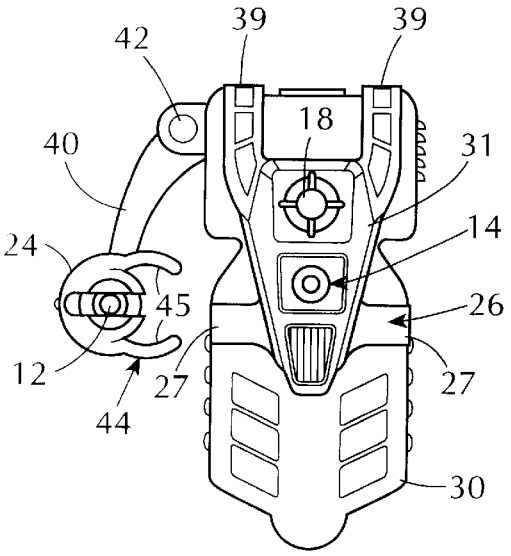
FIG. 2 is a front view of a removable backpack embodying the invention worn by the action figures depicted in FIG. 1.
Figure 3:
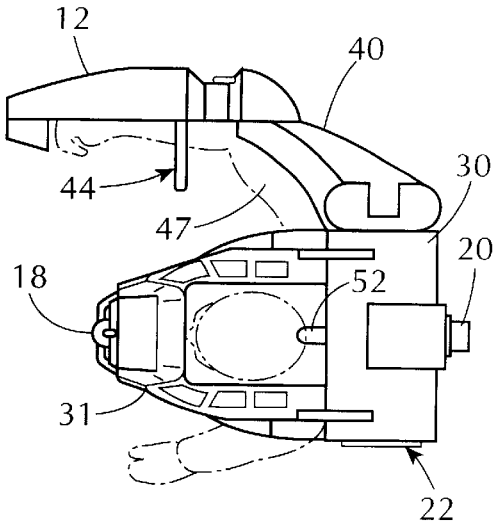
FIG. 3 is a rear view of the backpack, with the torso of the action figure represented in broken lines.

FIG. 1 illustrates a shooting game played with two toy action FIGS. 10 which each are armed with a radiated energy emitter 12, and each have a radiated energy sensor 14 (FIG. 2) compatible with the wave energy emitters 12. Each action FIG. 10 also includes a circuit 16 (FIG. 6) coupled to the respective emitter 12 and sensor 14 to control the respective component, and one or more hit indicators 18 coupled to the respective circuit 16 which audibly or visually indicate a hit whenever the circuit 16 determines that a hit has occurred. As shown in FIG. 1, the hit indicator 18 is a light (lamp or LED) which is illuminated to indicate a hit. An input device in the form of a push button switch 20 is provided on each action FIG. 10 for activating the respective emitter 12. Other suitable input devices may be used, such as touch switches, motion switches, proximity switches, etc.

In the embodiment of FIGS. 1–4, the emitter 12, the sensor 14, the circuit 16, the hit indicator 18 and the push button switch 20 are mounted or coupled to a toy part, specifically a backpack accessory 22, removably attached to an action FIG. 10. However, the backpack 22 (or other toy part) may be non-removably attached to the action figure, or may form part of the action figure, i.e., be formed as part of or be integral with the action figure. The emitter 12 is coupled to the backpack 22 and is mounted in a weapon 24 is removably attached to the action FIG. 10. In other embodiments, not shown, the backpack may be permanently attached to the action figure, or some or all of the components 12, 14, 16, 18 and 20 may be mounted to the action figure. In still other embodiments, not shown, some or all of those components may be mounted to another accessory attached or coupled to an action figure, such as a larger weapon (e.g., a hand-held missile launcher, anti-tank weapon or bazooka, etc.), or a weapon attached to or coupled to a vehicle, etc. In other words, it is within the contemplation of the invention that the components described above be mounted in any appropriate toy part such as an accessory or weapon, or in any appropriate part of an action figure, e.g., the turret of a tank.

Coupling or mounting the components to the backpack (or other toy part or accessory) provides advantages and enhances the play value of the game. For example, mounting and/or coupling the components to the backpack can simplify manufacture and reduce cost, particularly in the case of smaller action figures less than about ten inches in height (e.g., 3¾ inch and 5⅞ inch action figures). Also, where the backpack is made removable, regardless of the size of the action figure, different backpacks can be provided with different shooting game features, as disclosed in cited patent applications, or with different visual features and different configurations, or different weapons may be coupled to them, etc.

For example, backpacks can be provided with single shot operation, or with automatic and semi-automatic shot operation. Also, backpacks may have different shot capabilities before requiring reloading, or different reloading options, or with no reloading possible for a given game or time period. The radiated energy shots fired by different backpacks may also be weighted (e.g., by codes) with different hit values, i.e., a hit from a given backpack may score a given number of points on the backpack that detects the hit. Further, certain backpacks may be configured to transfer functions and features to other backpacks, e.g., in codes carried by the radiated energy. Children may select what they believe to be an appropriate backpack for a given situation. This adds play value prior to the game, involved with the initial selection, and during the game as the player finds out how appropriate the selection was. If a game permits backpacks to be changed during the game, still more play value is provided associated with making and implementing the in-game choices. This of course applies not only to removable backpacks, but also to other removable parts and accessories.

These features may be programmed into the circuit 16 as described in the cited patent applications. The circuit 16 and the components may be mounted to the action figure, and the features may be provided by programming the action figure as described in the cited patent applications.

Figure 5:
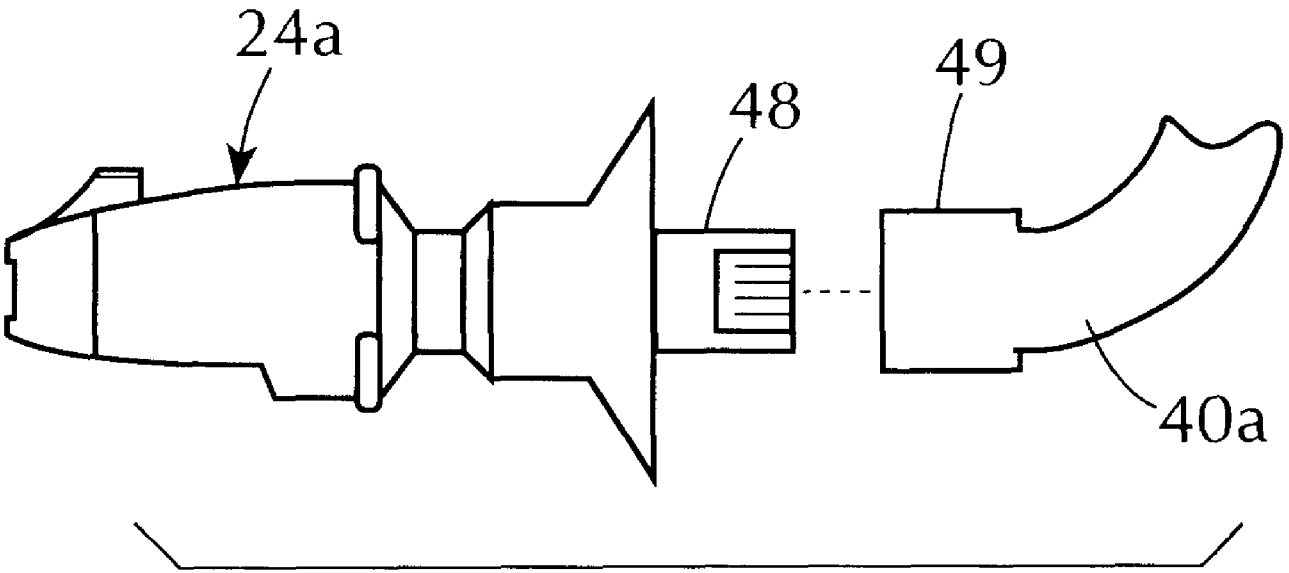
FIG. 5 is a side view of a weapon incorporating an emitter which can be removably plugged into part of a backpack accessory.
Figure 6:
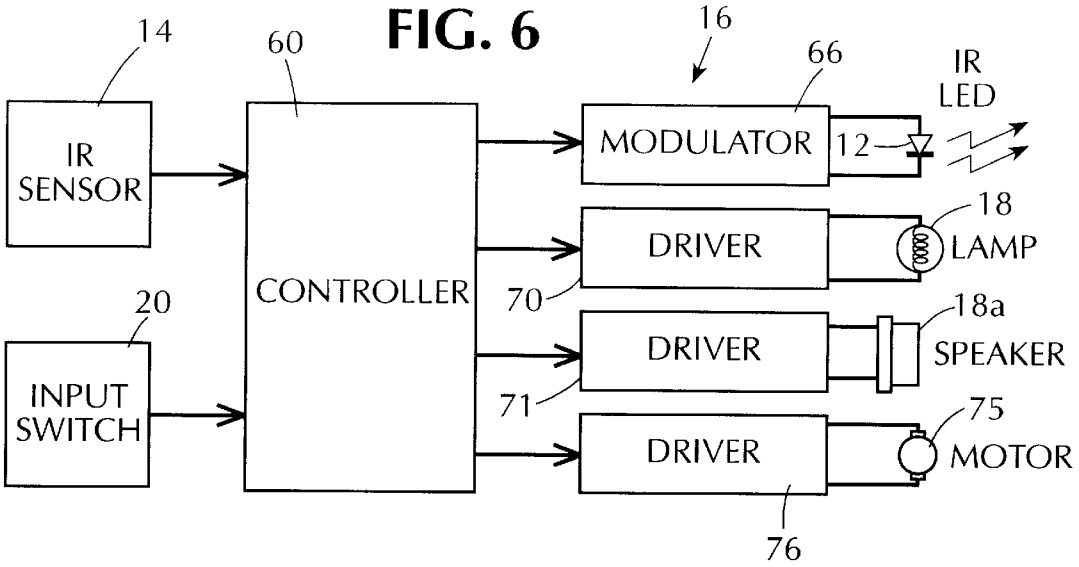
FIG. 6 is an electrical block diagram of the circuitry within or coupled to the backpack.

The backpack 22 includes a rear section 30 and a front section 31 hinged thereto. Mounted in the rear section are most of the components represented in the electrical schematic diagram shown in FIG. 6, including batteries (not shown). All or some of those components may be mounted on a printed circuit board (not shown). The components including the batteries, a speaker and the printed circuit board may be mounted in any suitable manner. For example, the batteries may be mounted in the lower part of the rear section 30 positioned in a stack extending laterally (horizontally) across the rear section. The sensor 14 is mounted to the front section 31 of the backpack 22. Wires (not shown) couple the sensor 14 to the rest of the circuit 16 in the backpack rear section 30. In the embodiment depicted in FIGS. 1–5, as mentioned above, the hit indicator 18 is a light (lamp or LED) mounted to the backpack front section 31, which is coupled to the rest of circuit 16 by wires (not shown). The wires may be run internally of the shoulder harness elements 39 (FIG. 2) from the components mounted in the backpack front section 31 to the rear section 30. As shown in FIG. 6, a speaker 18*a* may also be provided as a hit indicator, which is mounted in the backpack rear section 30. U.S. Pat. No. 5,147,237, the disclosure of which is incorporated herein by reference, discloses an example of the mounting of circuit components, a speaker and button batteries in a small enclosure.

The weapon 24 may be attached or coupled to the action FIG. 10 in any suitable manner, either removably or non-removably, and may be either movable relative to the action figure or non-movable. In the embodiment depicted in FIGS. 1–4, the weapon 24 is removably attached to the action FIG. 10 and is non-removably coupled to the backpack 22, and is movable with respect to the torso of the action FIG. 10. Referring to FIGS. 1–4, weapon 22 is connected to an arm 40 coupled to the backpack 22 by a frictional pivot joint 42 (FIG. 2) which keeps the pivoted position of the arm 40. A clasp 44 extends from the weapon 24 sized to engage the fore arm of the action FIG. 10. The prongs 45 of the clasp flex outwardly as the weapon 24 is pressed onto the forearm of the action FIG. 10, and then return inwardly to their unstressed state to engage the respective action figure.

The emitter 12 is mounted to the weapon 24 coupled to the rest of the circuit 16 in the backpack rear section 30 by wires (not shown). The wires may be run internally of the arm 40 from the emitter 12 to the rear section 30.

Figure 4:
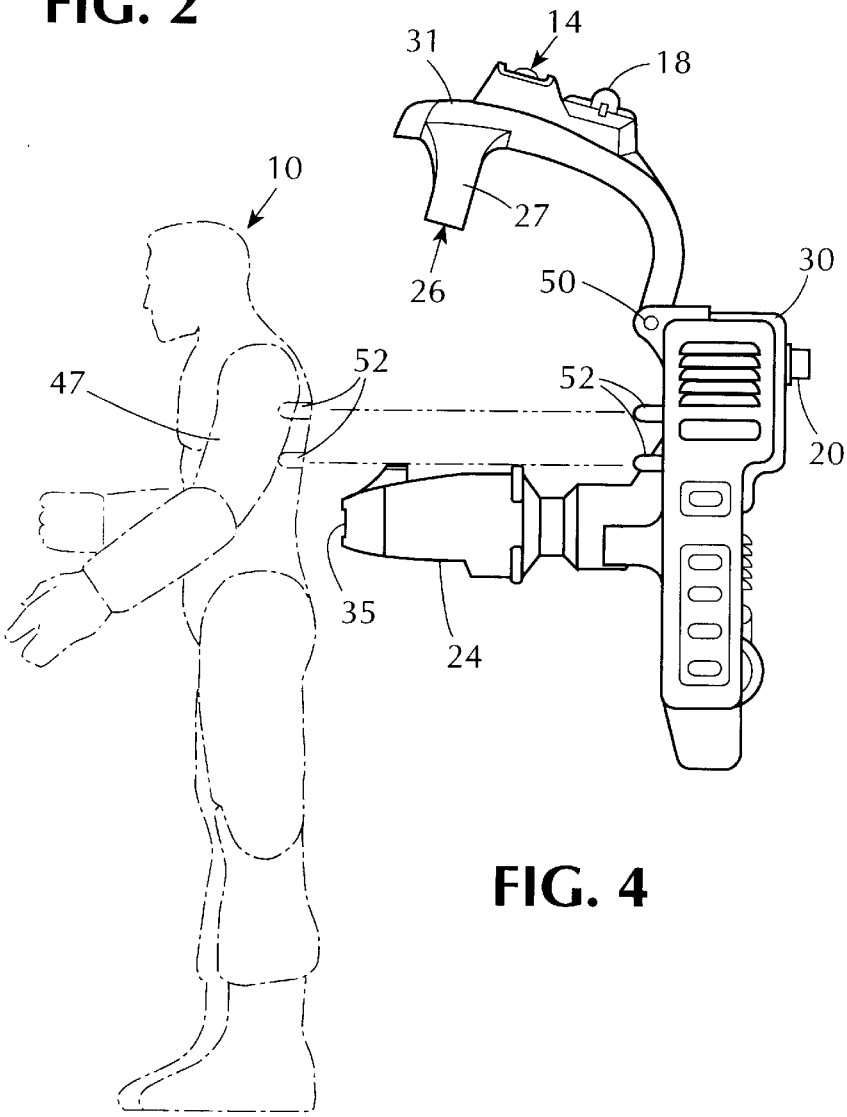
FIG. 4 is a side view of the backpack, shown in exploded fashion with respect to the action figure which is represented in broken lines.

Referring to FIGS. 1 and 4, the arms 47 of the action FIG. 10 are pivoted at the shoulder and at the elbow by a simple frictional pivot or by a frictional ball joint, which keep the position to which the arm and forearm are moved, and which permit the arm and forearm to be moved into numerous positions. Thus, the weapon 24 may be aimed by suitably positioning the arm 47 to which the weapon is coupled, as well as by positioning or manipulating the action figure itself.

The emitter 12 is suitably mounted to the weapon 24 to emit energy therefrom for a desired range. In the case of a light emitter 12, it is set back within the weapon 24 spaced from a light-transmitting aperture 35 through which light is emitted from the weapon 24. The space between the light emitter 12 and the aperture 35 is tubular in shape and sized to provide a desired range for the light emitter 12. For example, the space and aperture, and the light source are selected to provide a beam of from approximately two to four inches in diameter at distances of from approximately six to 12 feet. Of course, use of an optical system which includes a lens, as disclosed for example in applications Ser. Nos. 08/795,895 and 09/15,863 cited above, would extend the effective playing range. The emitter 12 may be a light source that emits IR or visible light.

The backpack 22 may be mounted to an action FIG. 10 in any suitable manner. In the embodiment of FIGS. 1–4, the front section 31 is hinged to the rear section 30 by a pivot 50 (FIG. 4), preferably a frictional pivot that keeps its pivoted position, and the backpack front section 31 includes a flexible clasp 26 sized to fit around the waist of the action figure. The backpack rear section 30 has spaced projections 52 extending from the inside of the backpack rear section 30 which are snap-fitted into holes 53 in the back of the action FIG. 10. With the backpack front section 31 pivoted to its open position shown in FIG. 4, the backpack 22 is pressed onto the action FIG. 10 to seat the backpack projections 52 in the action figure holes 53. As the front section is pivoted to its closed position shown in FIG. 1, the prongs 27 of the clasp 26 flex outwardly, and then return inwardly to their unstressed state to engage the action figure. The backpack 22 may be mounted to the action figure in other ways, for example as disclosed in U.S. Pat. Nos. 5,073,140 and 5,147,237.

In other embodiments, the backpack 22 and the weapon 24 may be permanently attached to the action FIG. 10 in any suitable way, and the weapon 24 may be movable or stationary with respect to the action figure. For example, referring to FIG. 5, the weapon 24*a* has an electrical connector part 48 and the arm 40*a* (pivotally connected to the backpack 22 as shown in FIGS. 1–4) has a mating electrical connector part 49 into which the connector part 48 is plugged and unplugged to make electrical connection of the emitter 12 with the circuit 16 via conductors (not shown) extending from the connector part 49 to the circuit 16. The connector parts 48 and 49 may be mating telephone connectors, or any other suitable connectors. The weapon 24*a* may be supported by the connectors 48, 49 and/or by the clasp 44 (not shown in FIG. 5).

A shooting game is played by the action FIGS. 10 as manipulated by a child or two children (or more with more action figures) to fire (radiate) energy at the sensor 14 of an opposing action figure. Prior to the game, each player selects a backpack for each action figure, if a supply of backpacks is available. During play, each player grasps an action FIG. 10, or a single player grasps two action FIGS. 10, and tries to score a hit on the opposing action figure. The children manually pose the figures, manually position the arms (and the weapons) and manually move the figures to fire in a selected direction and/or to avoid being hit from the fire of another action FIG. 10. Thus, young children can play the shooting game without difficulty, and a relatively low cost but high tech toy is provided for children to play an interactive shooting game.

The backpacks 22 may be provided with any of the features described in the cited patent applications, in addition to simply determining and indicating hits. The backpacks may also be provided with sound effects and voice messages, as described in U.S. Pat. Nos. 5,073,140 and 5,147,237, all cited above. Game play is altered to the extent appropriate to use these features and functions. To provide even more play value, the emitter, the sensor and the circuit components can be mounted to a gun and a vest (instead of a backpack) which resemble the gun and vest of the "Laser Challenge Pro" toy (available from Toymax Inc.) worn by human players as direct participants in a shooting game.

FIG. 6 depicts a block diagram of an embodiment of a circuit 16 for implementing an IR emitting and detecting action FIG. 10. Circuit 16 includes a controller 60, an IR sensor 14, the push button switch 20, an IR LED 12, a modulator (or oscillator) 66 for modulating the input of the IR LED 12, the hit light 18 (in the form of a lamp) and a speaker 18*a*. The microcontroller 60 receives and processes the output of the IR sensor 14, and in response thereto controls the hit light 18 and the speaker 18*a*, via appropriate drivers 70, 71. The controller 60 also receives the output of the push button switch 20 and in response thereto provides signals to the modulator 66 for the IR LED 12.

The width of a burst of light emitted by the IR LED 12 may fixed or variable. If the shooting game provides only for the shooting and detection of light, and for no functions which would require the emitted light to carry information, then the modulator 66 may provide for a single fixed burst width. If the light emitted by the IR LED 12 is to carry information for providing game features and functions as discussed below and described more fully in the cited patent applications, then modulator 66 may provide for light bursts of different width. The modulator 66 may be similar to the one disclosed in Application ser. No. 08/795,895, which can modulate the input to the IR LED 12 in a single fixed width or in different widths, as controlled by the controller 60. Although the modulation circuit 66 and the controller 60 are represented by separate blocks in FIG. 6, they can be implemented in the same integrated circuit as well as by separate circuits.

Controller 60 includes a speech synthesizer, and is capable of providing signals to the driver 71 for the speaker 18*a* for realistic sound effects and speech. The controller 60 may be as described in Application Ser. No. 08/795,895, e.g., a 528 Series microcontroller available from Winbond Electronics Corp. Alternatively, controller 60 may be an SN67003 microcontroller available from Sonix Technology Co., Ltd. Other suitable controllers may be used, which may include a modulating circuit therein, in which case the modulator 66 may be eliminated or replaced by a drive transistor, or the like. The IR sensor 14 may be a 12043 Series infrared receiver available from Kodenshi Corp. The 12043 Series receiver detects infrared light radiated at a carrier frequency of 37.9 KHz., and provides a logic level change output in response to detection.

If the action figures are configured to perform any of the functions disclosed in the cited patent applications, in addition to simply determining and indicating hits, then as discussed above the controller 60 and the modulator 66 provide a plurality of codes for the light emitted by the LED 64 (e.g., represented by the width of the emitted light burst). Correspondingly, the controller 60 is effective to determine and control the function represented by the codes in the emitted light. Input controls, circuitry and/or a computer may be provided to program the backpacks (or the action figure to which the circuit 16 is mounted), and upload and download programming, features, functions and use information, etc. Where the toy objects are small in size, such as smaller action figures, vehicles, etc., a connector (e.g., a standard telephone connector 48 as shown in FIG. 5) may be provided for removably connecting input devices such as a keypad or computer, etc.

The electrical circuitry described above implements the emission and detection of IR light. However, visible light could be emitted instead of IR light, and suitable sources and circuitry for effecting the transmission and detection of visible light are known to those of skill in the art.

If desired the circuit 16 may also control a motor 75 via a driver 76 in response to determination of a hit. The motor may move a part of the action figure to indicate a hit, such as tilting the head, toppling the figure, bending the torso, etc. The motor may also provide a feelable output which a player can feel, such as vibrations, ejection of a liquid, etc.

The circuit 16 also includes a speech synthesizer, as mentioned above, which may be incorporated in the controller 60. This adds play value in that the action figures or other toy objects may not only sound a sound effect when a hit is determined or when firing, but also various sound effects associated with other functions such as reloading, rapid fire, out of shots, etc. Moreover, the controller may store speech phrases coordinated with the particular action figure or functions performed by the action figure or other toy object. The speech and sound effects can be sounded automatically according to the controller program, or in response to switch activation or sensor activation (e.g., loading a new backpack on an action figure).

The accessory contemplated by the invention may be embodied in a base which supports a toy figure, particularly a miniature figure as small as 1 to 2 inches. The base may serve the function of mechanically supporting the figure, as well as housing electrical components, as described for the backpack accessory. The base may include a receptacle for snap fitting the feet of the figure therein, or the base and the figure may include a projection and mating receptacle of any suitable shape, e.g., tutbular or rectangular, etc., or a bayonet type connection. The base may have attached thereto the sensor 14 and the hit indicator 18, while the emitter 12 could be mounted to a weapon removably attached to the figure. Alternatively, the sensor 12 and the hit indicator 18 may be mounted to a vest which is removably attached to the figure.

If desired, the removable backpacks 22 (or other removable toy part) may be equipped with a receiver for remote control of one or more features or functions implemented by the backpacks. Remote control may be in addition or in lieu of the push button switch 20. Such a receiver and a remote control are known to those of skill in the art. This provides a limited remote control feature which can be implemented at low cost.

Figure 7:
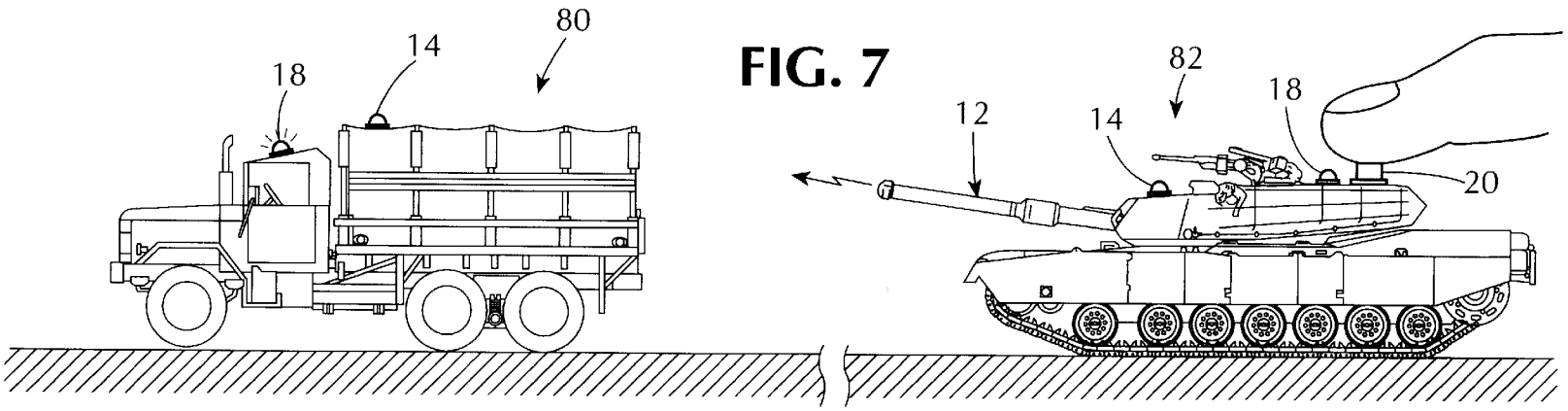
FIG. 7 is a side view of representations of an unarmed military transport vehicle and an armed military tank which embody the invention.

Toy objects may be implemented with energy sensors and detection circuitry only, i.e., they may not be provided with an energy emitter and thus are "unarmed" and can not shoot at other toy objects. FIG. 7 depicts a representation of an unarmed military transport vehicle 80 including at least one sensor 14 being fired at by a military tank 82. Preferably, either the one sensor 12 is omni-directional, or multiple sensors are provided (e.g., connected in a logical OR configuration) to receive compatible energy over 360 degrees. The vehicle 80 is also provided with a hit light 18 and a speaker (not shown). The vehicle 80 may include the same circuit 16 as provided in the backpack 22, except that the IR LED 12 and the modulating circuitry 66 are omitted. The tank 82 may include all of the circuitry in or coupled to the backpack 22.

In a game played with one or more action FIGS. 10 (or other objects having an energy emitter), a player may try to move the vehicle 80 to its destination without the vehicle being hit by the tank 82, or by an action figure carrying an anti-tank type weapon. The vehicle may be provided with storage space, which may, for example, hold additional backpacks that may be used if the vehicle reaches its destination.

While the invention has been described and illustrated in connection with preferred embodiments, many variations and modifications, as will be evident to those skilled in the art, some of which are described or mentioned herein, may be made without departing from the spirit and scope of the invention. For example, as discussed above, features and functions disclosed in the cited patent applications may be implemented in the action figures, backpacks, accessories, toy parts, etc., described or mentioned herein using the components described in those applications. Also, features and functions other than those described herein, and variations of the features and functions described herein are possible. Further, the invention may be embodied in objects other than those shown in the drawings, for example, in military vehicles such as planes, ships, in space craft, in dolls, robots, spacemen, creatures and animals, etc. Still further, certain parts may be removable and some embodiments which incorporate removable parts may include remote control of one or more features. The invention as set forth in the appended claims is thus not limited to the precise details of construction set forth above as such variations and modifications are intended to be included within the spirit and scope of the invention as defined in the appended claims.

What is claimed is:

1. A toy action figure comprising an energy source that radiates energy, a first circuit coupled to said energy source to cause said energy source to selectively radiate energy in response to a signal supplied to said first circuit, an energy sensor responsive to compatible energy radiated by another energy source which is compatible with the energy radiated by said energy source, a second circuit coupled to said sensor which cooperates with said sensor to make a determination that a hit has occurred when said sensor receives compatible energy, and a hit indicator device coupled to said second circuit which is responsive to said second circuit to provide an audible or visual output when said second circuit determines that a hit has occurred.

2. The toy action figure of claim 1 comprising a toy weapon carried by said action figure, said energy source being mounted to radiate energy from said weapon.

3. The toy action figure of claim 2 comprising a backpack attached to said action figure, said first circuit being located in said backpack, and said energy source in said weapon being coupled to said first circuit in said backpack.

4. The toy action figure of claim 3 wherein said backpack is removably attached to said action figure.

5. The toy action figure of claim 1 comprising a backpack attached to said action figure, said second circuit being located in said backpack and said sensor being positioned on a front of the action figure and coupled to said second circuit in said backpack.

6. The toy action figure of claim 1 comprising a manually-operable control coupled to said first circuit which selectively radiates energy in response to manual activation of said control.

7. The toy action figure of claim 1 wherein said action figure is adapted to be manually movable during play by a human player to direct energy therefrom in a desired direction.

8. The toy action figure of claim 5 wherein said hit indicator comprises a visual device positioned on a front of said action figure and coupled to said second circuit in said backpack.

9. A toy action figure comprising an energy source that radiates energy, a first circuit coupled to said energy source to cause said energy source to selectively radiate energy in response to a signal supplied to said first circuit, an energy sensor responsive to compatible energy radiated by another energy source which is compatible with the energy radiated by said energy source, a second circuit coupled to said sensor which cooperates with said sensor to make a determination that a hit has occurred when said sensor receives compatible energy, and a hit indicator device coupled to said second circuit which is responsive to said second circuit to provide an audible or visual output when said second circuit determines that a hit has occurred, a backpack attached to said action figure, said first and second circuits being located in said backpack, said energy source and said sensor being separated from said backpack and being coupled to said first and second circuits, respectively, in said backpack.

10. The toy action figure of claim 9 comprising a toy weapon carried by said action figure, said energy source being mounted to radiate energy from said weapon.

11. The toy action figure of claim 9 wherein said sensor is positioned on a front of the action figure.

12. The toy action figure of claim 9 wherein said hit indicator device comprises a visual device positioned on a front of said action figure and coupled to said second circuit in said backpack.

13. The toy action figure of claim 9 comprising a manually-operable control coupled to said first circuit which selectively radiates energy in response to manual activation of said control.

14. The toy action figure of claim 9 wherein said action figure is adapted to manually movable during play by a human player to direct energy therefrom in a desired direction.

15. The toy action figure of claim 9 comprising a front section attached to said backpack extending over a front of said action figure, said sensor being carried by said front section.

16. The toy action figure of claim 15 wherein said hit indicator device comprises a visual device carried by said front section and is coupled to said second circuit in said backpack.

17. The toy action figure of claim 9 wherein said backpack is removably attached to said action figure.

18. A toy backpack for a toy action figure comprising an energy source that radiates energy spaced from said backpack, a first circuit located inside said backpack electrically coupled to said energy source to cause said energy source to selectively radiate energy in response to a signal supplied to said first circuit, a manually operable switch coupled to said first circuit and providing said signal upon a change of state of said switch, an energy sensor spaced from said backpack responsive to compatible energy radiated by another energy source which is compatible with the energy radiated by said energy source, a second circuit located in said backpack coupled to said sensor which cooperates with said sensor to make a determination that a hit has occurred when said sensor receives compatible energy, and a hit indicator device coupled to said second circuit which is responsive to said second circuit to provide an audible or visual output when said second circuit determines that a hit has occurred.

19. The toy backpack of claim 18 comprising a toy weapon coupled to said backpack, said energy source being mounted to radiate energy from said weapon.

20. The toy backpack of claim 19 comprising an arm mechanically coupling said weapon to said backpack.

21. The toy backpack of claim 18 comprising a front section attached to said backpack adapted to extend over a front of the action figure when said backpack is mounted thereto, said sensor being carried by said front section.

22. The toy backpack of claim 18 wherein said hit indicator device comprises a visual device carried by said front section and is coupled to said second circuit in said backpack.

* * * * *